US011028466B2

(12) United States Patent
Chen et al.

(10) Patent No.: US 11,028,466 B2
(45) Date of Patent: Jun. 8, 2021

(54) UNLEADED FREE-CUTTING BRASS ALLOYS WITH EXCELLENT CASTABILITY, METHOD FOR PRODUCING THE SAME, AND APPLICATION THEREOF

(71) Applicant: Fortune Manufacturing Co., Ltd., Taipei (TW)

(72) Inventors: Chin-Lung Chen, Taipei (TW); Jhewn-Kuang Chen, Taipei (TW); Ci-Jie Hung, Taipei (TW)

(73) Assignee: Fortune Mfg. Co., Ltd., Taipei (TW)

( * ) Notice: Subject to any disclaimer, the term of this patent is extended or adjusted under 35 U.S.C. 154(b) by 18 days.

(21) Appl. No.: 16/070,559

(22) PCT Filed: Jan. 12, 2017

(86) PCT No.: PCT/US2017/013171

§ 371 (c)(1),
(2) Date: Jul. 17, 2018

(87) PCT Pub. No.: WO2017/127284

PCT Pub. Date: Jul. 27, 2017

(65) Prior Publication Data

US 2019/0040499 A1 Feb. 7, 2019

(30) Foreign Application Priority Data

Jan. 21, 2016 (TW) ..... 105101917

(51) Int. Cl.

| | |
|---|---|
| ***C22C 9/04*** | (2006.01) |
| ***C22C 1/03*** | (2006.01) |
| ***B22D 21/02*** | (2006.01) |
| ***C22F 1/08*** | (2006.01) |

(52) U.S. Cl.

CPC ..... *C22C 9/04* (2013.01); *B22D 21/025* (2013.01); *C22C 1/03* (2013.01); *C22F 1/08* (2013.01)

(58) Field of Classification Search

CPC ..... C22C 9/04; C22C 1/03; B22D 21/025; C22F 1/08

See application file for complete search history.

(56) References Cited

U.S. PATENT DOCUMENTS

| | | | | |
|---|---|---|---|---|
| 2,101,930 | A * | 12/1937 | Davis | C22C 9/06 420/479 |
| 7,628,872 | B2 | 12/2009 | Zhang et al. | |
| 2006/0289094 | A1 | 12/2006 | Zhang et al. | |
| 2012/0251382 | A1 | 10/2012 | Peng et al. | |
| 2013/0129531 | A1 | 5/2013 | Baker et al. | |
| 2013/0129561 | A1 | 5/2013 | Tameda et al. | |
| 2014/0234156 | A1 | 8/2014 | Uchida | |
| 2014/0248175 | A1 | 9/2014 | Lee et al. | |
| 2019/0040499 | A1 | 2/2019 | Chen et al. | |

FOREIGN PATENT DOCUMENTS

| | | | |
|---|---|---|---|
| CA | 2718613 | A1 | 4/2012 |
| CN | 101343702 | A | 1/2009 |
| CN | 101386931 | A | 3/2009 |
| CN | 102071336 | B | 1/2013 |
| CN | 102828064 | B | 6/2014 |
| CN | 103930576 | A | 7/2014 |
| EP | 1038981 | A1 | 9/2000 |
| EP | 1045041 | A1 | 10/2000 |
| EP | 1559802 | A1 | 8/2005 |
| JP | S569347 | A | 1/1981 |
| JP | 2001064742 | A | 3/2001 |
| JP | 2007517981 | A | 7/2007 |
| TW | 421674 | B | 2/2001 |
| TW | 577931 | B | 3/2004 |
| TW | 200930822 | A | 7/2009 |
| WO | WO-2013115363 | A1 | 8/2013 |
| WO | WO-2015137048 | A1 | 9/2015 |
| WO | WO-2017127284 | A1 | 7/2017 |

OTHER PUBLICATIONS

English Machine Translation of the Description in Shuping et al. (CN 101386931) (Mar. 18, 2009).*

Davis, J.R., "ASM Specialty Handbook: Copper and copper alloys, Chapter: Melting and Casting", American Society for Metals International, 2001, pp. 171-194.

Kobayashi, T., et al., Materia Japan, 2004, vol. 43, pp. 647-650.

Oishi, K., et al., "Dezincification Corrosion Resistance and Mircostructure of Lead-Free-Cuttin Copper Alloy", Japan Inst. Metals, 2003, vol. 67, No. 5, pp. 219-225.

Puathawee, S., et al., "Lead-free Cu—Si—Zn Brass with Tin Addition", Advanced Materials Research, 2013, vol. 802, pp. 169-173.

Taha, M., et al., "Machinability characteristics of lead free-silicon brass alloys as correlated with microstructure and mechanical properties", Ain Shams Engineering Journal, 2012, vol. 3, pp. 383-392.

Zheng, L-S., "Casting Alloy and Its Melting", Northwestern Industrial University, 1994, pp. 117.

International Search Report for PCT/US2017/013171 dated Apr. 10, 2017.

Written Opinion of the International Searching Authority for PCT/US2017/013171 dated Apr. 10, 2017.

* cited by examiner

*Primary Examiner* — Jessee R Roe

(74) *Attorney, Agent, or Firm* — Offit Kurman, PA; Zhun Lu

(57) ABSTRACT

The present invention is directed to an unleaded free cutting brass alloy with excellent machinability, leak-tightness, reca stability, and mechanical properties, wherein the brass alloy comprises 65 to 75 weight % of copper, 22.5 to 32.5 weight % of zinc, 0.5 to 2.0 weight % of silicon, and other unavoidable impurities; wherein the total content of copper and zinc in the brass alloy is 97.5 weight % or more.

19 Claims, 4 Drawing Sheets

UNLEADED FREE-CUTTING BRASS ALLOYS WITH EXCELLENT CASTABILITY, METHOD FOR PRODUCING THE SAME, AND APPLICATION THEREOF

CROSS-REFERENCE TO RELATED APPLICATIONS

This application is a national stage application (under 35 U.S.C. § 371) of PCT/US2017/013171, filed Jan. 12, 2017, which claims benefit of Taiwanese Application No. 105101917, filed Jan. 21, 2016, both of which are incorporated herein by reference in their entirety.

FIELD OF THE INVENTION

The present invention is directed to an unleaded free-cutting, brass, particularly for an unleaded free-cutting brass having excellent machinability, leak-tightness, recastability, and mechanical properties.

BACKGROUND OF THE INVENTION

Traditional leaded copper alloy possesses good machinability and mechanical properties. Leaded copper alloy has been widely used in industrial materials, such as a water valve or a hardware part in the commodity sector. For copper alloys to produce a valve, such as a ball valve, good machinability of the alloy casting is necessary. In addition to the anti-corrosion properties of a copper alloy for use in various fluid environments, lead is an important additive element for a copper alloy casting valve of, for example, plumbing equipment or ship parts. Lead can embrittle turning scraps of a copper alloy during a machining process, so as to improve the machinability of a copper alloy. However, owing to the awareness of environmental protection issues, lead, which is conventionally added for improving the machinability of an alloy, has been under consideration for replacement by other alloying elements. During a leaded copper alloy fabricating process, a lead-containing steam may be produced, which is detrimental to human health and also causes heavy metal pollution issues for the environment. In this vein, advanced countries have recently placed increasing emphasis on environmental protection issues. The Drinking Water Systems Standards and Protocols of NSF has been published in northern America; the Restriction of the use of certain hazardous substances (RoHS 2.0) in Europe; and the Lead-free Law was passed in California to seriously restrict the lead content in copper alloys and the amount of lead leaching in drinking water.

To reduce the lead content in a leaded copper alloy, bismuth is often used to replace lead to improve the machinability thereof. Patent Nos. CN 102828064 B and CN 102071336 B disclose that the machinability of high-bismuth-containing brass having 0.3 to 3.5 weight % of bismuth is very close to that of a leaded brass. However, because the melting point of bismuth is only 271° C., high-bismuth-containing brass has a tendency for hot cracks during the freezing course after casting. In addition, a high-bismuth-containing brass is not an ideal valve material for welding use, because once the welding temperature is higher than the melting point of bismuth, hot cracking often occurs and thus causes a valve leak during conveyance of a high-pressure gas or fluid.

To reduce the use of bismuth, replacing bismuth with cheap and easily accessible silicon is a new trend. Conventionally, the suitable additive elements for an unleaded brass alloy comprise silicon, bismuth, graphite, tin, iron, calcium, and so on. Adding a suitable amount of silicon to a brass alloy has advantages associated with producing solid solution strengthening and improving the flowability during casting and the weldability of an alloy. Therefore, one of the major aspects for developing an environmental-friendly brass alloy is adding silicon as an additive for producing an unleaded brass alloy, such as a conventional ASTM C87800 silicon bronze alloy, wherein 3.8 to 4.2 weight % of silicon is added to brass alloy. A high-silicon-containing unleaded bronze alloy having excellent mechanical strength and anti-correction performance is achieved. However, due to the increment of the silicon content in a conventional ASTM C87800 alloy, the range of the mushy zone of the alloy is significantly expanded. ASTM C87800 alloy is categorized as an alloy having a wide freezing range of 95° C. in the materials handbook (see Copper and copper alloys published by the American Society for Metals, Chapter: Copper Alloy). This property can easily make a casting formed from an ASTM C87800 alloy produce defects with a loose microstructure during a freezing operation, which renders the as-produced castings to have poor leak-tightness performance and cause leaking.

The conventional C87800 silicon bronze alloy is a ternary alloy composed of Cu-14Zn-4Si. Because the alloy comprises silicon and less than 15 weight % of zinc, it has excellent anti-dezincification corrosion performance similar to that of red copper. However, the silicon content of the C87800 alloy being higher than 4 weight % widens the freezing range of silicon bronze and leads to a mushy freezing type during a freezing operation. In die casting process, the permanent mold dissipates heat rapidly and suitable runner design can be used to guide the freezing directionality of the casting. While most other copper alloy manufacturers use a sand mold casting process, the C87800 alloy castings solidify slowly, to form castings with loose microstructures, which cannot meet the requirements for practical use.

Patent Nos. TW 577931 and TW 421674 disclose that although adding 2 to 4 weight % of silicon as the major strengthening element to an unleaded brass alloy to improve the castability through enhancing the flowability of the melt, hard precipitates of the κ- or γ-phase produced by silicon may reduce the tool life of a cutting tool. Therefore, a trace amount of lead (less than 0.4 weight %) is still added to improve the machinability of a tool.

Taha et. al. [Ain Shams Engineering Journal, vol. 3, 2012, pp. 383-392.] conducted research based on conventional leaded silicon brass (60 weight % of Cu, 0.25 to 5.5 weight % of Si, and 0.15 to 0.5 weight % of Pb). They found that when 1 to 4 weight % of Si and 0.5 weight % of Al are added to a Muntz metal alloy to replace lead, and the silicon content reaches 3 to 4 weight %, η-$Cu_8ZnSi$ and χ-$Cu_8ZnSi$ may be precipitated. Therefore, the microstructure of the alloy becomes finer, and the alloy has higher strength and better flowability. However, the porosity of a casting is also increased. Puathawee et. al, [Advanced Materials Research, Vol. 802, 2013, pp. 169-173] found that in a Cu—Zn—XSi-0.6Sn (X=0.5, 1, 2, 3) alloy, when the silicon content is increased, the γ-phase may be precipitated at the phase boundary of the isometric β-phase, so as to form a reticular structure. The addition of tin may make the μ-phase and γ-phase of the alloy more uniformly distributed than those without the addition of tin. The hardness is increased to HV398. The formation of the γ-phase may ease the turning scraps to be broken, whereas the hard and brittle characteristics of the γ-phase may also make tool wear more seriously.

Given the above, the solid solution strengthening effect of adding silicon is promising. Therefore, in order to control an adequate amount of silicon to prevent the formation of excessive hard γ-phase, Oishi et. al. (Sampo Copper Alloy Co. Ltd., Japan) [Materials Transactions, vol. 67, 2003, pp. 219-225] invented an unleaded silicon brass alloy comprising 75.5Cu-3Si-0.1P—Zn, which is composed of the α-, γ- and κ-phases without precipitating β-phase and the equilibrium μ-phase. The alloy possesses good forgeability, castability, anti-dezincification performance, and machinability.

A wide freezing range influences the filling behavior of a liquid phase during freezing. If the liquid phase cannot effectively fill the space among the complex dendrites, fine porosity is formed in a casting. Therefore, it is very important to understand the range of a freezing range of alloy. Takeshi Kobayashi and Toru Maruyama ("Lead-free copper alloy for casting," Materia Japan, vol. 43, 2004, pp. 647 to 650) use a thermocouple to show that the freezing range of an unleaded CAC403 (Cu-10Sn-2Zn) alloy is larger than that of a leaded CAC406 (Cu-5Sn-5Pb-5Zn) alloy. This shows that removing lead from a copper alloy influences the castability of the alloy. Therefore, the melting and casting conditions of a copper alloy should be strictly controlled.

Given the above, a novel unleaded brass alloy, which meets the requirements of both the lead-free standard and the convenience needed for mass production, is desirable to replace the conventional leaded copper alloy. Such unleaded brass needs to have excellent castability and machinability without producing any loose microstructure during a casting process. The high quality valve casting made from such alloys has excellent leak-tightness and anti-dezincification corrosion performance and meets the requirements for transporting gas or fluid.

In this connection, the present invention targets modifying the composition of a conventional silicon bronze to address the issues associated with a widened freezing range, in particular, the alloy composition according to the present invention targets a casting process using a sand mold, so that the defects, such as a loose microstructure or a shrinkage cavity tendency, resulting from a mushy freezing zone may be reduced, and the quality of a casting may be improved.

SUMMARY OF THE INVENTION

In order to meet the requirements of an environmentally sustainable development and industrial applications, producing lead-free products with acceptable mechanical strength and castability is needed. The present invention starts by using conventional cartridge brass as a base material and further uses silicon as a main alloying element along with the complex addition of a trace amount of other alloying elements, such as aluminum, antimony, tin, manganese, nickel or boron, to improve the characteristics of an unleaded silicon brass alloy.

One aspect of the present invention is to provide an unleaded free-cutting brass alloy, which avoids the long freezing process resulting from a wide freezing range of a conventional ASTM C87800 high silicon-containing bronze alloy. The wide freezing range prolongs a freezing process of the alloy, so the as-produced casting is filled with porous microstructure, which leads to poor leak-tightness. On the other hand, Patent Nos. TW 577931 and TW 421674 disclose that adding a high content of silicon to a copper alloy may produce hard and γ-phases; therefore, the tool life of a cutting tool is reduced, and the processing time of the cutting or machining process may be increased. The above issues are also addressed in the present invention.

Another aspect of the present invention is to provide an unleaded brass alloy having excellent castability, machinability and weldability, wherein the unleaded brass alloy of the present invention comprises 65 to 75 weight % of copper, 22.5 to 32.5 weight % of zinc, 0.5 to 2.0 weight % of silicon, and other unavoidable impurities. The alloy composition according to the present invention fulfills the requirements of the materials for producing high quality valves.

The addition of silicon according to the present invention may form a small amount of precipitates between dendritic crystals. The precipitates are the positions for crack initiation in the turning scraps during a cutting process, so that they may solve the deficiencies of a high silicon-containing, brass alloy associated with being hardly welded and having poor machinability.

Surprisingly, it was found that when the zinc content of a brass alloy of the present invention is adjusted to 22.5 to 32.5 weight %, the silicon content is reduced to 0.5 to 2.0 weight %, and the total content of copper and zinc in the brass alloy is 97.5 weight % or more, preferably from 97.5 to 98.5 weight %, such brass alloy may continuously crystallize α-Cu from the liquid phase in the two-phase zone. Meanwhile, the latent heat of solidification may be continuously released so as to prevent the decrease of the internal temperature of an alloy. Therefore, under a non-equilibrium freezing condition, once the concentration of the residual zinc atoms in the liquid phase reaches the threshold for initiating a peritectic reaction, the α-phase consumes the solute-rich liquid phase, nucleates, and grows from the surface of primary α-Cu crystals. Therefore, the peritectic reaction, L+α-Cu→α-phase occurs. In the cooling curve, the reaction plateau of the peritectic reaction lower than the liquidus line and declined to the temperature of 859.7° C., at which the peritectic reaction is completed. The mushy temperature zone is only 31.7° C. Therefore, the freezing range of the brass alloy is narrowed. In other words, by increasing the zinc content of the unleaded free-cutting brass alloy in the present invention, the liquidus line of the alloy may be significantly decreased. However, adding the alloying element other than copper and zinc to the brass alloy may often increase the proportion of the crystalline phase other than α- and β-phases. This could render the mushy zone to possibly be enlarged to 50° C. or more. Surprisingly, it was found that the mushy zone of the brass alloy of the present invention, having the total content of copper and zinc of 97.5 weight % or more, preferably from 97.5 to 98.5 weight %, may be significantly reduced to about 30° C. with respect to the conventional brass alloy.

On the other hand, when the brass alloy according to the present invention comprises the total content of copper and zinc being 97.5 weight % or more, preferably from 97.5 to 98.5 weight %, and 0.5 to 2.0 weight % of silicon, the microstructure of the brass alloy is composed of α- and β-phases. A skilled person in the art understands that there is a balance between the α-phase exhibiting high ductility and the improvement of the machinability of turning scraps resulting from an aggregation of excessive silicon-rich γ-phase at the phase boundary, it was surprisingly found that according to the modification of such alloy composition of the present invention, the unleaded free-cutting brass alloy has both an adequate proportion of the α-phase for exhibiting suitable ductility, and proper proportion of the γ-phase for exhibiting acceptable machinability. In addition, the γ-phase of the unleaded free-cutting brass alloy of the present invention may be formed at the interface boundary of the α- and β-phases with a significant reduced amount of precipitation. The quantity of the reticular γ-phase precipitated along the β-phase boundary is significantly reduced and the γ-phase forms in a granular shape and distributed uniformly between the α- and β-phases. Therefore, the alloy composition of the unleaded free-cutting brass alloy according to the present invention makes the alloy possess adequate mechanical strength and achieve the efficacy of good machinability.

DETAILED DESCRIPTION OF THE INVENTION

Figure 1:
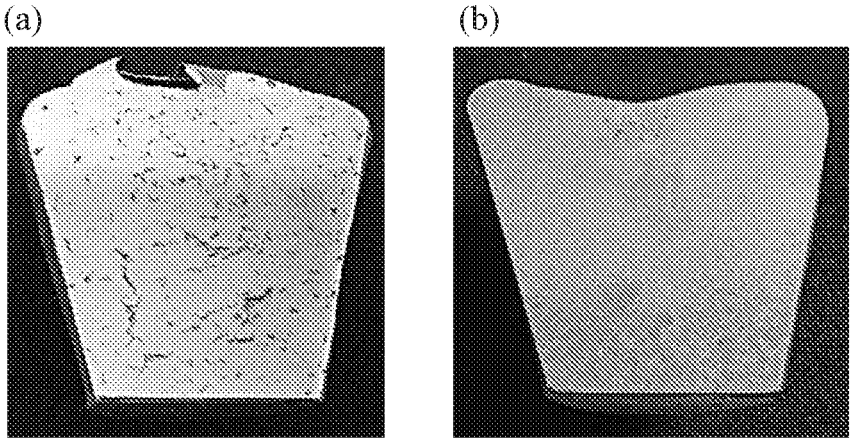
FIG. 1 shows the cross-sectional images of the recast ingots made from the foundry scrapes comprising (a) Comparative Example of ASTM C87800 silicon bronze (prior art); and (b) the unleaded free-cutting brass alloy according to the present invention, S73M5; the cross-sectional image of S73M5 shows a relatively dense microstructure with good shrinkage.
Figure 2:
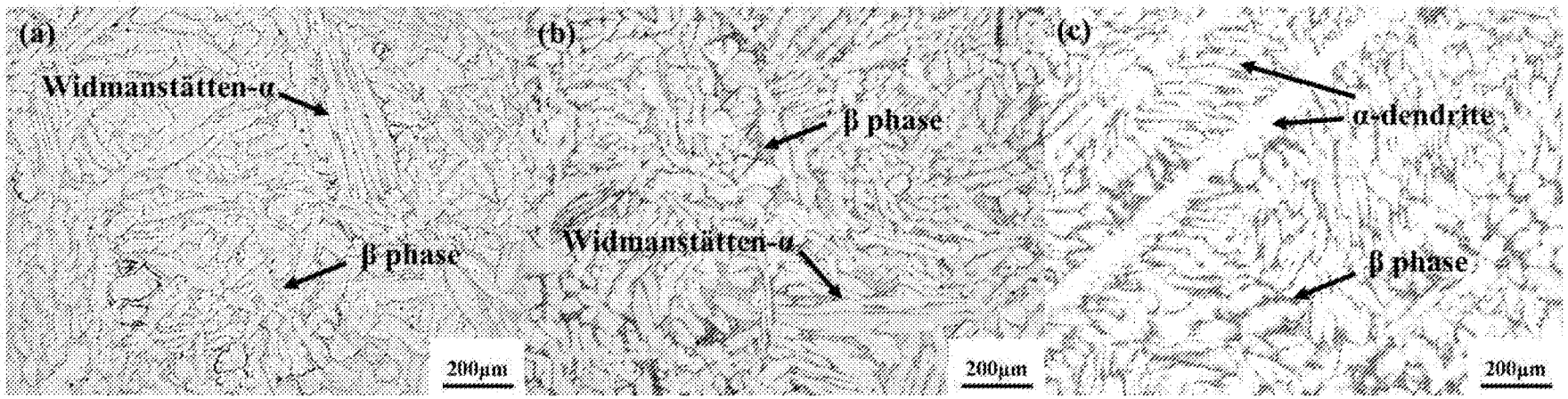
FIG. 2 shows the optical microscope images of the unleaded free-cutting brass alloy of the present invention, T73M: (a) T73M5, (b) T73M5B, (c) T73M5N.

The unleaded free-cutting brass alloy according to the present invention may further comprise at least one element selected from the group consisting of aluminum, tin, manganese, nickel, antimony and boron, wherein the total content of the element(s) is 2.5 weight % or less.

The unleaded free-cutting brass alloy according to the present invention may further comprise at least one element selected from tin, manganese, nickel or antimony, wherein the contents of tin, manganese or antimony are each 0.01 to 0.55 weight %, or the content of nickel is 0.01 to 0.8 weight %, and wherein the total content of the element(s) is 2.5 weight % or less.

The unleaded free-cutting brass alloy according to the present invention may further comprise at least one element selected from the group consisting of 0.1 to 1.0 weight % of aluminum, 0.01 to 0.55 weight % of tin, 0.01 to 0.55 weight % of manganese, 0.01 to 0.8 weight % of nickel, 0.01 to 0.55 weight % of antimony, and 0.001 to 0.1 weight % of boron, wherein the total content of the element(s) is 2.5 weight % or less.

The unleaded free-cutting brass alloy according to the present invention has a total content of copper and zinc of 97.5 weight % or more, preferably from 97.5 to 98.5 weight %.

The unleaded free-cutting brass alloy according to the present invention has the lower limit of copper content of 65 weight %, 67 weight %, or 68 weight %, whereas the upper limit of the copper content is 70 weight %, 73 weight %, or 75 weight %. The range of the copper content can be any combination of the aforementioned lower and upper limits, such as preferably 65 to 75 weight % or 68 to 70 weight %.

The unleaded free-cutting brass alloy according to the present invention has the lower limit of silicon content of 0.5 weight %, 0.75 weight %, 1 weight %, 1.1 weight %, 1.15 weight %, 1.3 weight %, or 1.45 weight %, whereas the upper limit of the silicon content is 1.35 weight %, 1.5 weight %, 1.75 weight %, or 2.0 weight %. The range of the silicon content can be any combination of the aforementioned lower and upper limits, such as preferably 1.0 to 1.5 weight % or 1.1 to 1.35 weight %.

The unleaded free-cutting brass alloy according to the present invention may further comprise aluminum, wherein the lower limit of the aluminum content is 0.1 weight %, 0.15 weight %, 0.2 weight %, or 0.25 weight %, whereas the upper limit of the aluminum content is 0.30 weight %, 0.45 weight %, 0.5 weight %, 0.6 weight %, or 1.0 weight %, The range of the aluminum content can be any combination of the aforementioned lower and upper limits, such as 0.1 to 1.0 weight %, preferably 0.2 to 0.5 weight %, or more preferably 0.15 to 0.30 weight %.

The unleaded free-cutting brass alloy according to the present invention may further comprise 0.01 to 0.55 weight % of tin, wherein the lower limit of the tin content is 0.01 weight %, 0.05 weight %, 0.075 weight %, 0.10 weight %, 0.20 weight %, or 0.25 weight %, whereas the upper limit of the tin content is 0.10 weight %, 0.20 weight %, 0.25 weight %, 0.3 weight %, 0.40 weight %, 0.45 weight %, or 0.55 weight %. The range of the tin content can be any combination of the aforementioned lower and upper limits, such as preferably 0.01 to 0.2 weight %, or more preferably 0.01 to 0.1 weight %.

The unleaded free-cutting brass alloy according to the present invention may further comprise 0.01 to 0.55 weight % of manganese, wherein the lower limit of the manganese content is 0.01 weight %, 0.05 weight %, 0.075 weight %, 0.10 weight %, 0.20 weight %, or 0.25 weight %, whereas the upper limit of the manganese content is 0.10 weight %, 0.20 weight %, 0.25 weight %, 0.3 weight %, 0.40 weight %, 0.45 weight %, or 0.55 weight %. The range of the manganese content can be any combination of the aforementioned lower and upper limits, such as preferably 0.01 to 0.25 weight % or more preferably 0.10 to 0.20 weight %.

The unleaded free-cutting brass alloy according to the present invention may further comprise 0.8 weight % or less of nickel, wherein the lower limit of the nickel content is 0.01 weight %, 0.05 weight %, 0.075 weight %, 0.10 weight %, 0.20 weight %, or 0.25 weight %, whereas the upper limit of the nickel content is 0.10 weight %, 0.20 weight %, 0.25 weight %, 0.3 weight %, 0.40 weight %, 0.45 weight %, or 0.55 weight %, 0.65 weight %, 0.78 weight %, or 0.80 weight %. The range of the nickel content can be any combination of the aforementioned lower and upper limits, such as 0.01 to 0.55 weight %, preferably 0.01 to 0.25 weight %, or more preferably 0.10 to 0.20 weight %.

The unleaded free-cutting brass alloy according to the present invention may further comprise 0.01 to 0.55 weight % of antimony, wherein the lower limit of the antimony content is 0.01 weight %, 0.05 weight %, 0.075 weight %, 0.10 weight %, 0.20 weight %, or 0.25 weight %, whereas the upper limit of the antimony content is 0.10 weight %, 0.20 weight %, 0.25 weight %, 0.3 weight %, 0.40 weight %, 0.45 weight %, or 0.55 weight %, The range of the antimony content can be any combination of the aforementioned lower and upper limits, such as 0.1 to 0.45 weight %, preferably 0.15 to 0.45 weight %, or more preferably 0.20 to 0.45 weight %.

The unleaded free-cutting brass alloy according to the present invention may further comprise 0.001 to 0.1 weight % of boron, wherein the lower limit of the boron content is 0.001 weight %, 0.005 weight %, 0.01 weight %, 0.02 weight %, 0.03 weight %, 0.04 weight %, 0.05 weight %, 0.06 weight %, 0.07 weight %, 0.08 weight %, or 0.09 weight %, whereas the upper limit of the boron content is 0.005 weight %, 0.01 weight %, 0.015 weight %, 0.025 weight %, 0.035 weight %, 0.045 weight %, 0.055 weight %, 0.065 weight %, 0.075 weight %, 0.085 weight %, 0.095 weight %, or 0.1 weight %, The range of the boron content can be any combination of the aforementioned lower and upper limits, such as preferably 0.001 to 0.05 weight % or more preferably 0.001 to 0.02 weight %.

The unleaded free-cutting brass alloy according to the present invention has the unavoidable lead content of the brass alloy of 0.15 weight % or less, preferably 0.1 weight % or less.

The unleaded free-cutting brass alloy according to the present invention, has the unavoidable iron content of the brass alloy of 0.15 weight % or less.

The unleaded free-cutting brass alloy according to the present invention comprises other unavoidable impurities, for example, but not limited to, at least one element selected from bismuth, lead, iron, sulfur, phosphorus or selenium. The total content of the unavoidable impurities is 0.5 weight % or less, preferably 0.3 weight % or less.

According to one preferable embodiment of the unleaded free-cutting brass alloy according to the present invention, the brass alloy further comprises at least one element selected from the group consisting of 0.2 to 0.5 weight % of aluminum, 0.01 to 0.2 weight % of tin, 0.01 to 0.25 weight % of manganese, 0.01 to 0.55 weight % of nickel, 0.1 to 0.45 weight % of antimony, and 0.001 to 0.05 weight % of boron, wherein the total content of the element(s) is 2.5 weight % or less, and wherein the total content of zinc and copper is 97.5 weight % or more.

The present invention further relates to a casting process, wherein a melt of said brass alloy is used to cast said brass alloy in a green sand mold, a furan mold, or a metal mold, so as to produce a casting.

The casting process according to the present invention is conducted at a temperature suitable for casting of 930 to 1200° C., preferably 950 to 1100° C., and more preferably 1000 to 1080° C.

In the casting process of the present invention, the casting is subjected to machining to produce a machined workpiece and turning scraps thereof.

In the casting process of the present invention, the melt of the brass alloy further comprises the remelting of the machined workpiece or turning scraps thereof produced by the method according to the present invention.

As stated above, the unleaded free-cuffing brass alloy according to the present invention has excellent castability. Therefore, it is particularly suitable for any casting products, such as a casting product produced by a stand casting, a gravity casting, a metal mold casting process; a ship part; a water hardware; a piping part and accessories thereof; a valve, such as a ball valve, a gate valve, a check valve, a gate valve with or without a lifting rod, a butterfly valve; a filter, such as a Y-strainer; a pump; or a component having a complex shape, such as a bearing, a screw, a nut, a bushing, a gear, or a hydraulic component. The unleaded free-cutting brass alloy according to the present invention is particularly suitable for any pressure resistance products, such as a high-pressure valve, a nozzle, a high-pressure pipe, or a pressure pump.

The final and the most important demanding characteristic of the unleaded free-cutting brass alloy according to the present invention is the leak-tightness associated with a casting material. Therefore, the present invention further relates to an unleaded brass alloy casting product, such as a valve, for example, a ball valve, a gate valve, a check valve, a gate valve without a lifting rod, a gate valve with a lifting rod, or a butterfly valve; a piping part; or filter, for example, a Y-strainer, which comprise an unleaded free-cutting brass alloy according to the present invention.

The unleaded brass alloy casting product according to the present invention comprises a valve, for example, a ball valve, a gate valve, a check valve, a gate valve without a lifting rod, a gate valve with a lifting rod, or a butterfly valve; a piping part; or a filter, for example, a Y-strainer, which do not leak at a pressure of 900 psi or more.

The unleaded brass alloy casting product according to the present invention comprises a valve, for example, a ball valve, a gate valve, a check valve, a gate valve without a lifting rod, a gate valve with a lifting rod, or a butterfly valve; a piping part; or a filter, for example, a Y-strainer, wherein the lower limit of the tensile strength is 280 MPa or more, 331 MPa or more, 355 MPa or more, 409 MPa or more, 450 MPa or more.

The unleaded brass alloy casting product according to the present invention comprises a valve, for example, a ball valve, a gate valve, a check valve, a gate valve without a lifting rod, a gate valve with a lifting rod, or a butterfly valve; a piping part; or a filter, for example, a Y-strainer, wherein the lower limit of fracture elongation is 8% or more, 9% or more, 16% or more, 20% or more, 25% or more or 32% or more.

The unleaded free-cutting brass alloy according to the present invention possesses the following characteristics and advantages: 1. The alloy according to the present invention has machinability similar to that of a leaded brass. 2. The alloy according to the present invention has superior recastability and melting convenience. 3. The alloy according to the present invention has superior mechanical properties, so that it can be used in a welding process without having the risk of producing hot-shortness as that of a conventional bismuth-containing brass alloy, and has good leak-tightness. 4. The alloy according to the present invention has excellent anti-dezincification corrosion performance. The above characteristics all fulfill the requirements for the use of a high-value and high-quality valve.

The Freezing Range of the Unleaded Free-Cutting Brass Alloy

According to an embodiment of the present invention, when 0.1 to 1.0 weight % of aluminum and 0.01 to (155 weight % of tin are simultaneously added to the unleaded free-cutting brass alloy, since the minor elements, aluminum and tin, pertain to low-melting point elements with respect to copper, the liquid phase of the solute having a low-melting point may continuously release the latent heat until the whole freezing process has been completed. Therefore, the brass alloy may change states from a liquid phase to a complete solid phase at a much lower temperature. The temperature difference of the binary-phase zone of the brass alloy having a composite addition of aluminum and tin is about 60° C.

According to an embodiment of the present invention, 0.1 to 1.0 weight % of aluminum may be further added to the unleaded free-cutting brass alloy, wherein the temperature difference of the binary-phase zone still remains 35° C. In addition, by increasing the aluminum content to 1.0 weight %, the solidus temperature of a brass alloy can be further reduced, so that the temperature for completing the peritectic reaction can be reduced accordingly.

According to an embodiment of the present invention, 0.01 to 0.55 weight % of manganese may be further added to the unleaded free-cutting brass alloy. The temperature difference of the binary-phase zone of the brass alloy may be reduced to about 30° C.

On the other hand, at least one element selected from the group consisting of silicon, aluminum, tin and manganese may be added to the unleaded free-cutting brass alloy of the present invention to remove the undesirable gas in melt and to purify the melt. Therefore, the gas sources, which form gas pores during a freezing process, such as oxygen, nitrogen, hydrogen, or carbon dioxide, may be reduced. In addition to having a narrow freezing range of the unleaded free-cutting brass alloy of the present invention, the shape-filling capacity of the melt according to the present invention can be improved. After the casting and freezing processes, the unleaded free-cutting brass alloy of the present invention may form a dense casting microstructure. Therefore, the yield and leak-tightness performance of the resulting castings are significantly improved.

Mechanical Properties of the Unleaded Free-Cutting Brass Alloy

According to a preferred embodiment of the unleaded free-cutting brass alloy of the present invention, the silicon content is further reduced to 0.5 to 2.0 weight %, preferably 1.1 to 1.35 weight %, to prevent excess content of the γ-phase from being precipitated at the grain boundary, which may impart a negative impact on the mechanical properties. According to an embodiment of the present invention, 0.1 to 1.0 weight % of aluminum may be further added to the unleaded free-cutting brass alloy as a solid-solution-strengthening element.

According to a preferred embodiment of the unleaded free-cutting brass alloy of the present invention, when the silicon content is reduced to 0.5 to 2.0 weight %, preferably 1.1 to 1.35 weight %, the X-ray powder diffraction analysis result shows that the microstructure of the unleaded free-cutting brass alloy of the present invention is mainly composed of dual α- and β-phases. In addition, according to one embodiment of the unleaded free-cutting brass alloy of the present invention, when 0.1 to 1.0 weight % of aluminum can be further added to the brass alloy, the X-ray powder diffraction analysis result shows that the diffraction peak around 43.4° associated with the β-phase has a much higher intensity than those of the other peaks. This X-ray powder diffraction analysis result is consistent with the microstructure characterization result showing that the fraction of 3-phase is higher than the others.

Regarding the mechanical strength of the unleaded free-cutting brass alloy of the present invention, although the silicon content of the brass alloy is reduced to 0.5 to 2.0 weight %, preferably 1.1 to 1.35 weight %, the deficient of silicon can be made up by increasing the zinc content to 22.5 to 32.5 weight % or by additionally adding 0.1 to 1.0 weight % of aluminum. Therefore, the solid-solution-strengthening effect resulting from original silicon element still can be retained. Hence, the unleaded free-cutting brass alloy according to the present invention has a mechanical strength, which is very close to that of a commercial C87800 silicon bronze.

The Machinability of the Unleaded Free-Cutting Brass Alloy

Conventionally, the elements, lead and/or bismuth, are added to the alloy to modify the machinability of an alloy, so as to prolong the tool life of a cutting tool, to reduce the cost of a machining process, and to produce discontinuous turning scraps. However, such objectives also can be achieved by increasing the content of zinc in the brass alloy of the present invention to 22.5 to 32.5 weight %, while the total content of copper and zinc is 97.5 weight % or more. In addition, by increasing the zinc content, the hardness of the unleaded free-cutting brass alloy, may also be increased, whereas the β-phase having poor ductility also provides weakness points for initiating the cracks, so as to improve the machinability of turning scraps. Moreover, according to an embodiment of the unleaded free-cutting brass alloy, the formation of the hard γ- and κ-phases by adding 0.5 to 2.0 weight %, preferably 1.1 to 1.35 weight %, of silicon may also improve the machinability of turning scraps.

According to another embodiment of the present invention, 0.001 to 0.1 weight %, preferably 0.001 to 0.05 weight %, and more preferably 0.001 to 0.02 weight %, of boron or 0.01 to 0.8 weight % of nickel can be further added to the unleaded free-cutting brass alloy of the present invention. The addition of nickel in the brass alloy may transform the α-phase from Widmanstätten structures into dendrite structures. In comparison with the microstructure of an unleaded free-cutting brass alloy without adding any boron or nickel, the γ-phase of the boron or nickel-containing brass alloy is distributed within the α- and β-phases in granular shapes. Particularly, when boron is added to the brass alloy, the γ-phase may be precipitated along the grain boundary. On the other hand, a silicon-rich solute liquid may be discharged to the interspaces of the frozen α-phase dendrites through the addition of nickel to the brass alloy. Therefore, an inter-metallic compound of and γ-phases can be formed among the dendrites by adding 0.001 to 0.1 weight % of boron or 0.01 to 0.8 weight % of nickel to the alloy. From an EDS analysis, it is confirmed that the concentration of zinc and silicon of the γ-phase is higher than that of the matrix.

Although the γ-phase produced by adding 0.001 to 0.1 weight % of boron or 0.01 to 0.8 weight % of nickel may have a negative impact on the ductility of a brass alloy, due to the lack of a conventional cutting-free element, such as lead or bismuth, being added to the alloy, it is necessary to produce hard precipitates of a compound phase within the alloy for breaking the continuance of the microstructure. The precipitates may act as lead added in a copper alloy for enhancing the machinability of the turning scraps without greatly retarding the mechanical properties of the alloy. Given the above, the γ-phase affects both the mechanical properties and the machinability of the alloy. Furthermore, when 0.001 to 0.1 weight % of boron or 0.01 to 0.8 weight % of nickel is added to the brass alloy, the as-produced granular γ-phase, which is uniformly distributed between the α- and β-phases, may form an ideal precipitating type.

The Anti-Dezincification Corrosion Performance of the Unleaded Free-Eating Brass Alloy The unleaded free-cutting brass alloy of the present invention comprises 22.5 to 32.5 weight % of zinc. The fraction of the β-phase in the brass alloy is increased with the increment of the zinc content. When the zinc content is higher than 15 weight %, it may cause problems associated with a significantly selective dissolution of zinc. Therefore, porous and loose pure-copper may reside in the surface dezincification layer, i.e. a dezincification corrosion phenomenon.

The present invention provides an unleaded free-cutting brass alloy having said anti-dezincification corrosion performance. The brass alloy of the present invention may further comprise a trace amount of boron, nickel or antimony, so as to improve the anti-dezincification corrosion performance of the brass alloy.

According to an embodiment of the unleaded free-cutting brass alloy of the present invention, the brass alloy further comprises 0.001 to 0.1 weight %, preferably 0.02% or less, of boron and/or 0.01 to 0.8 weight %, preferably 0.01 to 0.55 weight %, of nickel to improve the anti-dezincification corrosion performance. According to another embodiment of the unleaded free-cutting brass alloy of the present invention, 0.01 to 0.55 weight %, preferably 0.15 to 0.45 weight %, and more preferably 0.25 to 0.45 weight % of antimony may be added to the unleaded free-cutting brass alloy of the present invention to improve the anti-dezincification corrosion performance. Therefore, the unleaded free-cutting brass alloy of the present invention meets the standard under ISO 6509-1:2014 stipulating a correction standard of less than 100 μm and significantly improves the anti-dezincification corrosion performance of the brass alloy. The brass alloy of the present invention not only complies with the lead-free standard of an unleaded brass alloy but also has better anti-dezincification performance. In addition, the brass alloy of the present invention significantly inhibits the dezincification corrosion behavior, when the zinc content of the brass alloy is higher than 15 weight %.

The Recastability of the Unleaded Free-Cutting Brass Alloy

One of the aspects of the present invention is to provide a brass alloy having good and convenient recastability. As stated above, the unleaded free-cutting brass alloy according to the present invention has a narrower freezing range. This allows the phase transformation process of a brass alloy to quickly pass through the mushy freezing zone during freezing. Hence, the unleaded free-cutting brass alloy according to the present invention may achieve an excellent casting convenience. The term "casting convenience" used herein refers to that situation when the raw materials including turning scraps, runners, and foundry returns for producing the alloy is fed to the furnace; due to the relative low melting-point characteristics of the alloy, both the melting time and the electric power consumption may be reduced. In addition, when the free-cutting alloy of the present invention is recast, no additional machine or chemical agent is used to remove the gas during a refining process. The melt according to the present invention has excellent flowability and purity. Regarding the casting process of the unleaded free-cutting brass alloy according to the present invention, since the turning scraps and the foundry returns of the castings can be effectively reused, the recycling costs may be greatly reduced. From the comparative example shown in FIG. 1(A), it is obvious that the casting recast from a conventional silicon brass alloy is filled with porous defects, whereas the casting recast from the unleaded free-cutting brass alloy of the present invention reveals not only good shrinkage behavior but also a dense microstructure without forming any defects of loose structure. As shown in FIG. 1(B), in comparison with the ASTM C87800 high silicon-containing brass alloy or the materials disclosed in Patent No. TW 577931, since the unleaded free-cutting brass alloy according to the present invention has relative low copper content, the costs of the raw material may be advantageously reduced. In addition, the novel unleaded brass alloy according to the present invention provides a solution to the technical problems associated with the formation of defects resulting from a freezing process. Therefore, the alloy composition of the present invention solves the leakage problems of a conventional silicon brass alloy for use of a high-pressure valve produced by a casting process.

When boron or nickel is added to the unleaded free-cutting brass alloy, the freezing range still remains around 35° C., and the temperature difference of the binary-phase zone is not increased.

According to another embodiment of the present invention, the unleaded free-cutting brass alloy further comprises 0.01 to 0.8 weight %, preferably 0.01 to 0.55 weight %, of nickel. The addition of nickel according to the present invention may affect the freezing type of the alloy. It is believed that the unleaded free-cutting brass alloy according to the present invention firstly crystallizes the α-phase Cu at 903° C. and then the β-phase at 888° C. When the temperature is decreased to the solidus temperature of the alloy, 869° C., which represents that the peritectic reaction of the β-phase and liquid phase is completed, two exothermic peaks can be observed from a DSC curve, which corresponds to the two crystallization sequences of the α-phase and β-phase. Since nickel pertains to an element for stabilizing the α-phase of the alloy and has a relative high melting temperature, the crystallization temperature of the α-phase may be increased accordingly.

According to one preferred embodiment of the unleaded free-cutting brass alloy of the present invention, the alloy comprises 65 to 75 weight % of copper and 97.5 to 98.5 weight % of copper and zinc in total. As stated above, silicon may positively impart a solid-solution-strengthening effect on the brass alloy. Therefore, the alloy of the present invention has good mechanical strength and ductility. The additive elements comprise 1.0 to 1.5 weight % of silicon, 0.1 to 0.6 weight % of aluminum, and at least one element selected from the group consisting of 0.01 to 0.2 weight % of tin, 0.15 to 0.45 weight % of antimony, and 0.01 to 0.25 weight % of manganese.

According to one preferred embodiment of the unleaded free-cutting brass alloy of the present invention, the unleaded free-cutting brass alloy having both excellent machinability and mechanical strength comprises 65 to 75 weight % of copper and 1.0 to 1.5 weight % of silicon, and further comprises 0.01 to 0.55 weight % of antimony. The copper-silicon-antimony compound, which is uniformly precipitated within the α-Cu solid solution, may produce a free-cutting effect similar to that of a brass alloy added with lead or bismuth, during a machining process. In addition, the unleaded free-cutting brass alloy of the present invention has advantages regarding being composed of a simple phase structure and having a temperature difference of the binary-phase zone being 30 to 35° C.

The principle of adding a large amount of manganese as a solid-solution-strengthening element in the brass alloy to form an inter-metallic compound may also be applied to the unleaded free-cutting brass alloy of the present invention. According to one preferred embodiment of the unleaded free-cutting brass alloy of the present invention, the alloy comprises 65 to 75 weight % of copper, 22.5 to 32.5 weight % of zinc, 0.5 to 2.0 weight % of silicon, 0.1 to 0.55 weight % of manganese, and 97.5 weight % or more of copper and zinc in total. It was surprisingly found that 0.1 to 0.55 weight % of manganese being added to the unleaded free-cutting brass alloy of the present invention may form a matrix of α-phase and a small amount of β-phase, wherein the hard $Mn_5Si_3$ inter-metallic compounds are distributed within the alloy and provide good wear resistance. The alloy still has a relatively narrow temperature difference of the binary-phase zone, of about 30 to 35° C.

EXAMPLE

The following states the examples of the present invention. As to the technical problems associated with the commercial unleaded copper materials, the following detailed disclosure and figures of the preferable embodiments of the unleaded free-cutting brass alloy according to the present invention clearly describe the advantages and characteristics over the prior art materials.

The embodiments of the present invention are as follows;

Example 1: Producing an Unleaded Free-Cutting Brass Alloy

C1100 pure copper, C87800 silicon bronze alloy ingot, and cartridge brass are used as the raw materials for melting. Before discharging from the furnace, the necessary amount of aluminum (99.9%), tin (99.8%), antimony (99.8%), boron copper, a 99% manganese copper alloy comprising 30 to 70 weight % of manganese, or C7541 copper-nickel-zinc alloy (copper-zinc-15% nickel alloy) can be additionally added to the melt. According to the desired alloy composition design, after being weighted with a desired amount of said smelting materials, they are fed into a graphite crucible of a high-frequency induction heating finance in the sequence from high to low melting-point thereof to be melted. In order to decrease the consumption of zinc during a melting process, pure zinc is added at a temperature of 930° C. The temperature is then increased to 1050'C.±25° C. to discharge the melt. After removing the slag of the surface oxide, the melt was poured into a preformed green sand mold at a temperature of 950° C. The composition of the as-formed casting is characterized by using a spectrometer (SPECTROMAXx, Germany), and the composition analysis results are shown in Table 1.

The melted materials used in the examples described in the present invention may be modified and selected by any skilled person in the art as needed. Except for copper, zinc and silicon, other components, such as aluminum or manganese, are not the essential elements to the present invention.

TABLE 1 the chemical composition analysis results of the unleaded free-cutting brass alloy of the present invention (in weight %).

| Sample No. | Zn | Si | Al | Sn | Mn | Ni | Sb | Fe | Pb | B |
|---|---|---|---|---|---|---|---|---|---|---|
| 73M4 | 29.05 | 2.25 | 0.386 | 0.351 | 0.520 | 0.003 | 0.00 | 0.063 | 0.005 | 0.00 |
| S73M5 | 29.16 | 1.24 | 0.229 | 0.073 | 0.483 | 0.017 | 0.00 | 0.032 | 0.004 | 0.00 |
| SA73M5 | 28.63 | 1.25 | 0.452 | 0.074 | 0.48 | 0.017 | 0.00 | 0.031 | 0.005 | 0.00 |
| BS73M | 27.58 | 1.35 | 0.01 | 0.10 | 0.04 | 0.017 | 0.45 | 0.032 | 0.004 | 0.00 |
| T73M5 | 29.52 | 1.32 | 0.329 | 0.124 | 0.288 | 0.016 | 0.00 | 0.032 | 0.002 | 0.00 |
| T73M5B | 29.08 | 1.3 | 0.278 | 0.118 | 0.136 | 0.016 | 0.00 | 0.005 | 0.001 | 0.1 |
| T73M5N | 28.03 | 1.29 | 0.235 | 0.108 | 0.280 | 0.778 | 0.00 | 0.032 | 0.001 | 0.00 |

Example 2: The Effects of the Silicon Content

The microstructure of the Comparative Example brass alloy 73M4 (Si>2.0%) consists essentially of the α-, ρ- and γ-phases, where the γ-phase is precipitated at the phase boundary of the μ-phase and within the β-phase. Since the γ-phase is hard and brittle, an excessive amount of the γ-phase being precipitated may overly increase the strength of the alloy, whereas the ductility is significantly decreased. The EDS analysis results show that the γ-phase is directed to a zinc- and silicon-rich compound. Because a large amount of rough γ-phase is precipitated at the β-phase boundary, it may impart a negative impact on the mechanical properties of an alloy. Particularly, it is believed that when the silicon content exceeds 2.0 weight %, the excessive silicon-rich γ-phase may start to be precipitated at the grain boundary. However, it was surprisingly found that when the silicon content of the unleaded free-cutting brass alloy, S73M5 or SA73M5, of the present invention is reduced to 2.0 weight % or less (about 1.24 to 1.25 weight %), the diffraction spectra show that the unleaded free-cutting brass alloy, S73M5 or SA73M5, consists essentially of dual α- and β-phases. In addition, the diffraction spectrum of SA73M5 shows that the intensity of the 1-phase peak at 43.4° is higher than the other diffraction peaks. This result is consistent with the microstructure of SA73M5, which reveals that the fraction of the 3-phase is increased.

On the other hand, the microstructure characterizations of S73M5 and SA73M5 proved that the α-phase of the alloy forms Widmanstätten structure, whereas the rest is the phase. Again, these results are consistent with their diffraction analysis results, in addition, there are no diffraction peaks associated with the γ-phase that can be found in the diffraction pattern. The SEM image of S73M5 shows that the γ-phase is mostly formed at the inter-phase boundary of the α- and β-phases, and the amount of the precipitation is significantly reduced. Therefore, the amount of reticular-shaped precipitates of the γ-phase precipitated along the β-phase boundary is significantly reduced. Accordingly, the γ-phase is transformed into a granular structure and uniformly distributed at the grain boundaries. Given the above, the experimental results show that the decrease of the silicon content in an unleaded free-cutting brass alloy of the present invention may decrease the amount of the γ-phase. In other words, by reducing the silicon content to 10 weight % or less according to the present invention, the strength and ductility of the brass alloy can be improved, so that the brass alloy of the present invention has suitable mechanical properties.

Example 3: Characterization of the Machinability

In Example 3, a conventional lathe is used to determine the machinability of turning scraps made from different copper alloy compositions under identical machining conditions. A commercialized disposable tungsten carbide having a nose angle radius of 0.4 mm is used as the turning tool. The turning conditions, 1 mm of the cutting inlet depth, 0.09 mm/rev of the feeding rate, and 550 r.p.m. of the turning speed, are used to characterize the machinability of the turning scraps. When the turning process is completed, 20 pieces of the turning scraps are randomly selected and weighed, and the length of the turning scraps are measured. The obtained results are categorized according to the ISO 3685 standard of turning scraps, so as to evaluate the machinability of a copper alloy.

Figure 3:
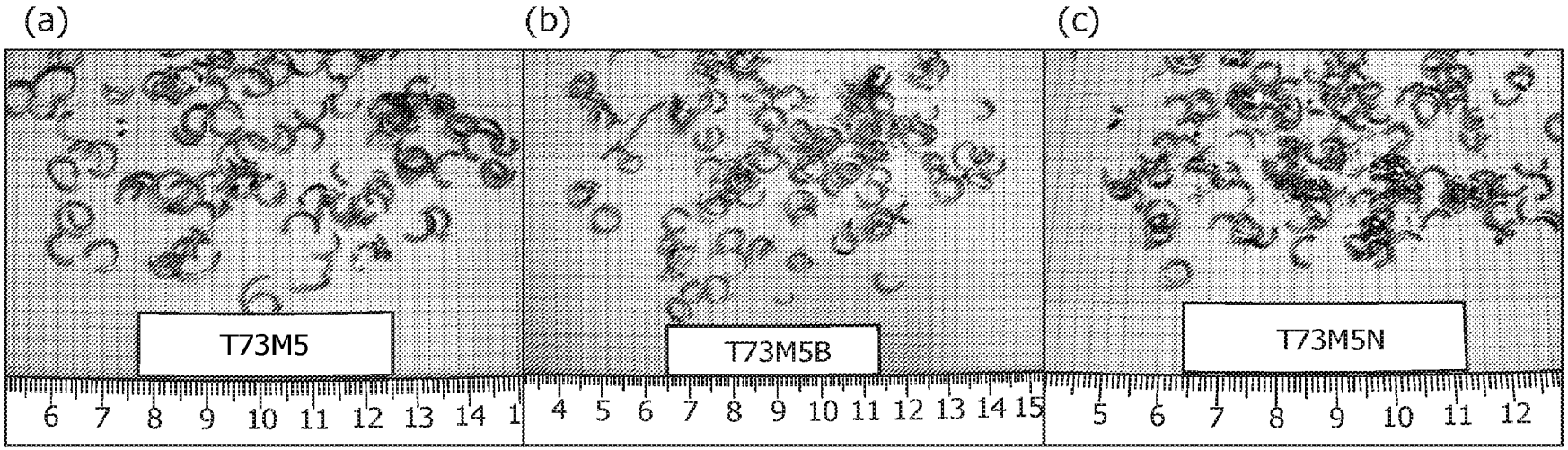
FIG. 3 shows the short C-shaped and discontinuous turning scraps by machining the unleaded free-cutting brass alloy of the present invention: (a) T73M5, (b) T73M5B, (c) T73M5N.

The microstructure of a conventional C36000 leaded free-cutting brass alloy is composed of the α- and β-dual phases and pure lead distributed at the α- and β-phase grain boundary. The microstructure features of the conventional C36000 alloy could meet the requirements of the machinability and mechanical strength in practical use. Therefore, the conventional C36000 leaded cutting-free brass is deemed as the standard sample and defined as a reference product having a machinability of 100%. In order to meet the requirements of the environmental protection policy, the present invention uses the γ-phase precipitates formed in the microstructures of the unleaded free-cutting brass alloy, such as T73M5, T73M5B, or T73M5N alloy, to improve the machinability of the turning scraps. FIG. 3 shows that the taming scraps of the T73M5, T73M5B, and T73M5N alloys have a discontinuous C-shape.

Considering the trade-off between the mechanical strength and the machinability of the alloy, the present invention is directed to designing an alloy composition having less impact on the mechanical strength. By modifying the silicon content, the hard γ-phase may be controlled, so that it is distributed at the phase boundary in a granular shape. Therefore, the detrimental influence of the hard precipitates on the mechanical strength of an alloy may be minimized. Consequently, the machinability of the brass alloy according to the present invention roaches a value similar to that of the C84400 leaded brass (having a machinability of 90%), and the processing time is close to that of a conventional leaded brass. The unleaded free-cutting brass alloy obviously has more advantages for mass production compared to the other two silicon brass alloys, as shown in Table 2. FIG. 3 shows that the turning scraps of the unleaded free-cutting brass alloy (the T73M5, T73M5B, and T73M5N alloys) have a discontinuous C-shape. This result reveals that the unleaded free-cutting alloy of the present invention possesses excellent machinability, and the turning scraps produced during a machining process may not adhere to the cutting tool. Given the above, the processing time of the alloy according to the present invention can be significantly minimized in comparison with those having hard κ- and γ-phases being present within the microstructure.

TABLE 2 the processing time for machining valves having an identical size.

| | Comparative Example ASTM C84400 | Example T73M Series | Comparative Example ASTM C87850 | Comparative Example ASTM C87800 |
|---|---|---|---|---|
| Processing time (sec) | 9 | 9.2 | 15 | 18 |

Example 4: Characterization of the Anti-Dezincification Corrosion Performance of the Copper Alloy In Example 4, an ISO standard testing method, ISO 6509-1:2014, was used to determine the anti-dezincification corrosion performance of a copper alloy. This standard testing method is particularly suitable for determining the anti-dezincification corrosion performance of a copper alloy having 15 weight % or more of the zinc content. According to the ISO standard testing method, 12.7 g of hydrous copper chloride ($CuCl_2.2H_2O$) was dissolved in 1000 ml of de-ionized water (<20 μS/cm), and then the copper chloride solution was heated and maintained at a temperature of 75-5° C. through water heating. The sample was then cut into a size of 10×10×5 ram, so that the exposure area of the sample for the testing solution was 100 $mm^2$. After being mounted, the surface of the sample was polished by a #1000 sandpaper. The sample was dipped in the solution for 24 h±30 min. After using de-ionized water to clean the surface of the sample, the sample was cut along the direction perpendicular to the bottom surface of the beaker. To avoid the detachment of the dezincification layer from the sample, a #2500 sandpaper was used to polish the cross-section plane, so that the dezincification layer could be distinguished from the uncorroded substrate. Therefore, the thickness of a dezincification layer and the uniform corrosion depth could be determined.

The total thickness of a partial dezincification layer of Comparative Example cartridge brass is 332 μm. The uniform corrosion depth resulting from the copper chloride etching solution of Comparative Example C87800 is 174 μm; however. Comparative Example C87800 does not have a partial dezincification layer. The uniform corrosion depth resulting from the copper chloride etching solution of Comparative Example C87850 is 133 μm, whereas the thickness of a partial dezincification layer is 72 μm, therefore, the total depth of the corrosion layer is 205 μm.

The thickness of the partial dezincification layer of the unleaded free-cutting brass alloy T73M5B is 181 μm. The uniform corrosion depth of BS73M is 45 μm, whereas the thickness of a partial dezincification layer is only 9 μm. Hence, the total corrosion depth of BS73M is only 54 μm. Given the above, the thickness of a partial dezincification layer resulting from the copper chloride etching solution of T73M5B is much thinner than that of 332 μm of Comparative Example, cartridge brass. In addition, the corrosion depth of BS73M is much thinner than the corrosion depth of 174 μm of Comparative Example, C87800. The anti-uniform corrosion performance of the BS73M alloy according to the present invention is much better than that of Comparative Example, C87800. However, the partial anti-dezincification corrosion performance of the BS73M alloy is slightly worse than that of C87800. The total corrosion depth of the B573M is thinner than that of Comparative Example, C87800. The resistance performance of the BS73M alloy to uniform corrosion and partial dezincification corrosion according to the present invention are both better than those of Comparative Example, C87850.

By comparing Example T73M5B and BS73M with Comparative Example cartridge brass alloy, having 70 weight % of copper and 30 weight % of zinc, the partial dezincification corrosion depth can be decreased from 332 μm to a relatively low level. The above results already prove that the unleaded free-cutting brass alloy according to the present invention have improved the anti-dezincification corrosion performance. Given the above, the unleaded free-cutting brass alloy according to the present invention meets the requirements of both AS2345 and ISO6509, which are directed to the standards of an anti-dezincification performance of a brass alloy.

Example 5: Characterization of the Recastability of the Alloy

The macrostructure of Comparative Example C87800 alloy prior to being recast is mostly composed of columnar grain structures. In addition, an unfilled porous structure is present among dendrite structure. Similar macrostructure can be found in Comparative Example C87800. Comparative Example C87850, and Example T73M5N of the present invention. After the alloy has been recast, it is found that the recast ingot of Comparative Example C87800 does not reveal a shrinkage cavity tendency during freezing; instead, the top surface of the ingot is expanded, and a large amount of loose defects are present inside the ingot. It is inferred that because a wide freezing range of Comparative Example C87800 alloy as well as the attachment of moisture and cutting oil to the re-melt of the foundry returns and turning scraps, the gas content of the alloy liquid is increased, and the porosity of the casting is increased. The wide freezing range of C87800 significantly reduces the casting convenience of the alloy, and the mechanical properties of a recast C87800 alloy cannot achieve the same level as an original C87800 alloy. It was surprisingly found that the recast unleaded free-cutting brass alloy of the present invention revealed a normal shrinkage cavity tendency during a freezing process. It is found that the microstructures of Examples T73M5 and T73M5B before or after being recast are both composed of dense isometric grains without the presence of porosity. This mans that Example T73M5 and T73M5B alloys have excellent casting recastability and acceptable mechanical strength.

The re-melt of the unleaded free-cutting brass alloy according to the present invention, which may pass through the runner several times and comprises machined workpieces and turning scraps having cutting oil attached thereon, may be directly fed into the furnace during a recycling melting process without adding any refining or degassing agent to the melt. Neither a chemical degassing process associated with a reduction reaction nor a physical degassing process involving decreasing the temperature of the melt is needed during a recycling smelting process. After the recycling process of the unleaded free-cutting brass alloy has been completed, the melt can be directly discharged when the temperature is reached. The casting process is conducted at a temperature suitable for casting of 930 to 1200° C., preferably 950 to 1100° C., and more preferably 1000° C. to 1080° C. After pouring the melt into a sand mold, the melt exhibits a normal shrinkage cavity tendency, excellent castability, casting convenience, and good mold filling ability. Therefore, the unleaded free-cutting brass alloy according to the present invention has excellent casting recastability and mold filling ability.

Example 6: Characterization of the Tensile Properties

Although the silicon content of the unleaded free-cutting brass alloy T73M5 is reduced to about 1.3 wt. %, the zinc content is increased accordingly to fulfill the deficiency of the solid-solution-strengthening effect contributed to silicon. Therefore, Example T73M5 alloy has a mechanical strength which is very close to that of Comparative Example C87800 silicon bronze.

Since the zinc content of Example T73M alloy is designed to become higher, the quantity of silicon being solid-soluble to the α- and β-phases is decreased. The microstructure characterization of a sample cross-section reveals that silicon added to the alloy cannot be completely dissolved in the α- and β-phases. Therefore, when the silicon concentration is higher than the maximum solid-solubility of the matrix, a hard and brittle zinc- and silicon-rich γ-phase may be precipitated. From the cross-section image of Example T73M5, a dimple feature resulted from a tensile deformation of the α-phase can be found. In addition, the granular γ-phase can be found in the fine dimple feature. The result shows that the granular γ-phase is uniformly distributed at the α- and β-phase boundary. Therefore, Example T73M5 alloy achieves an excellent ductility. In addition, it was surprisingly found that, after adding boron (T73M5B) or nickel (T73M5N) to the unleaded free-cutting brass alloy of the present invention, the elongation may be significantly decreased. The fracture surface is produced along the interface of the α-phase and γ-phase of the unleaded free-cutting brass alloy of the present invention. Moreover, the addition of nickel may make the fracture surface extend along the interface of each dendrite structure, which usually has poor toughness. Therefore, the fracture traces of the and γ-phases can be found on the surface of the dendrite structures without forming any obvious slip bands of the α-phase.

Example 7: The Application of the Unleaded Brass Alloy Valves

One aspect of the present invention is to provide an unleaded free-cutting brass alloy, having a leak-tightness characteristic. The unleaded free-cutting brass alloys of T73M5B, T73M5N, and BS73M are cast and then machined to form valves, such as ball valves, gate valves, check valves, gate valves with or without a lifting rod, butterfly valves, piping parts, Y-strainers, or valve caps. Except for the slag and sand voids formed on the appearance of a casting during a casting process, no other void or crack defects can be found. All of the castings formed from the unleaded free-cutting brass alloys of T73M5B, T73M5N, and BS73M meet the requirements of a gas pressure test under 88 psi or more, or the water pressure test under 900 psi or more (the actual water pressure for testing is from about 1,150 psi to 1,450 psi according to the MSS SP-110 Ball Valves, Threaded, Socket Welding, Solder Joint, Grooved and Flared Ends standard. Therefore, the microstructure features of the unleaded free-cutting brass alloy according to the present invention are particularly suitable for the use of the valve products, which require a pressure resistance of 900 psi or more.

Figure 4:
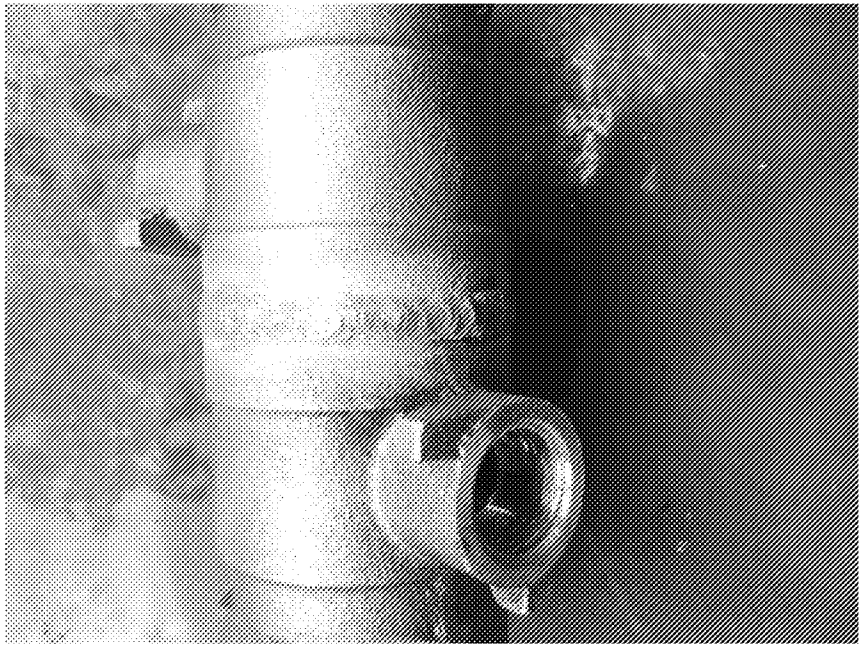
FIG. 4 shows the crack-free appearance around the welding beads of a valve cast from the unleaded free-cutting brass alloy according to the present invention (T73M5B).

Example 7 further demonstrates using the re-melts of the unleaded free-cutting brass alloys of T73M5B, T73M5N, and BS73M (comprising 40% of the turning scraps and 60% of the foundry returns having identical alloy compositions to those of T73M5B, T73M5N, and BS73M) to produce castings through a sand mold process. The valves are formed by first casting T73M5B, T73M5N and BS73M alloys, and then machining and welding the as-produced castings. FIG. 4 shows the appearances of a valve made from the unleaded freer cutting brass alloy of T73M5B. It can be seen that even the casting is welded; no crack can be found around the beads. Example 7 further shows that the valves formed by casting the re-melts of the unleaded free-cutting brass alloy of T73M5B, T73M5N and BS73M can pass the standard of leakage without producing any cracks in the microstructure. Therefore, the valves produced from the unleaded free-cutting brass alloys of the present invention sufficiently prove that they have the advantage of leak-tightness. Table 3 summarizes the features of T73M5B of the present invention in comparison with other conventional alloys.

Substantially, the valves formed from using the re-melt of the unleaded free-cutting brass alloy, T73M5B, T73M5N and BS73M, can reach tensile strengths of 355 MPa or more, 411 MPa or more, and 450 MPa or more, and fracture elongations of 25% or more, 20% or more, and 16% or more, respectively. The above-mentioned mechanical properties sufficiently prove that the tensile strength and ductility of the unleaded free-cutting brass alloy of the present invention can be significantly improved by adding a suitable amount of alloying element(s). Moreover, the valves formed by casting the unleaded free-cutting brass alloys according to the present invention all pass the pressure test under 900 psi or more, preferably 1150 psi or more, and more preferably 1500 psi or more, without producing any leakage.

Given the above, in view of the microstructure, machinability, recastability, mechanical properties, anti-dezincification corrosion performance, weldability, and leak-tightness of a casting of the unleaded free-cutting brass alloy of the present invention, modified by adding alloying element(s), all of the features distinguish the present invention from conventional copper alloys. Although the above examples relate to the valves for conveying fluid, variations of those preferred embodiments may become apparent to those of ordinary skill in the art upon reading the foregoing description. The inventors expect skilled artisans to employ such variations as appropriate, and the inventors intend for the invention to be practiced in manners other than as specifically described herein. Accordingly, this invention includes all modifications and equivalents of the subject matter recited in the claims appended hereto as permitted by applicable law. Moreover, any combination of the above-described elements in all possible variations thereof is encompassed by the invention, unless otherwise indicated herein or otherwise clearly contradicted by context.

TABLE 3

A summary of the features of the unleaded free-cutting brass alloy according to the present invention (T73M5B) in comparison with other conventional copper alloys.

| | Features | | | | | | |
|---|---|---|---|---|---|---|---|
| Sample No. | Cast-ability | Casting conve-nience | Recast-ability | Machin-ability | Leak-tightness under high pressure | Mechanical strength | Anti-dezincification performance |
| T73M5B | ◎ | ◎ | ◎ | ◎ | ◎ | ○ | ○ |
| C87800 | □ | □ | □ | □ | ○ | ◎ | ◎ |
| C87850 | ◎ | ◎ | ◎ | ○ | ◎ | ○ | ○ |
| C84400 | ◎ | ◎ | ◎ | ◎ | ◎ | ∇ | ◎ |
| C89520 | ◇ | ○ | ○ | ◎ | ○ | □ | ◎ |
| C89836 | ◎ | ○ | ○ | ◎ | ◇ | □ | ◎ |

Note:
Excellent ◎
Good ○
Acceptable ◇
Poor ∇
Worse □

What is claimed is:

1. An unleaded free-cutting brass alloy, comprising:
copper: 68 to 75 weight %,
zinc: 22.5 to <30 weight %,
silicon: 1.0 to 2.0 weight %,
at least one element selected from the group consisting of 0.01 to 0.8 weight % of nickel and 0.01 to 0.55 weight % of antimony, and
unavoidable impurities,
wherein the total content of copper and zinc in the brass alloy is 97.5 weight % or more, and
wherein the γ-phase of the brass alloy is uniformly distributed between phase boundaries of the α-phase and the β-phase of the brass alloy in a granular shape.

2. The brass alloy according to claim 1, further comprising at least one element selected from the group consisting of 0.01 to 1.0 weight % of aluminum, 0.01 to 0.55 weight % of tin, 0.01 to 0.55 weight % of manganese, and 0.001 to 0.1 weight % of boron.

3. The brass alloy according to claim 2, comprising 0.2 to 0.5 weight % of aluminum.

4. The brass alloy according to claim 2, comprising 0.01 to 0.2 weight % of tin.

5. The brass alloy according to claim 2, comprising 0.01 to 0.25 weight % of manganese.

6. The brass alloy according to claim 2, comprising 0.001 to 0.05 weight % of boron.

7. The brass alloy according to claim 1, wherein the brass alloy comprises 1.1 to 1.35 weight % of silicon.

8. The brass alloy according to claim 1, comprising 0.01 to 0.55 weight % of nickel.

9. The brass alloy according to claim 1, comprising 0.1 to 0.45 weight % of antimony.

10. An unleaded brass alloy casting product, comprising a brass alloy according to claim 1.

11. The unleaded brass alloy casting product according to claim 10, comprising a valve, a piping part, or a filter.

12. The unleaded brass alloy casting product according to claim 10, comprising a ball valve, a gate valve, a check valve, a gate valve with or without a lifting rod, a butterfly valve, or a Y-strainer.

13. The unleaded brass alloy casting product according to claim 10, wherein the brass alloy does not leak under a pressure of 900 psi or higher.

14. The unleaded brass alloy casting product according to claim 10, wherein the tensile strength of the brass alloy is 280 MPa or higher.

15. The unleaded brass alloy casting product according to claim 10, wherein the fracture elongation of the brass alloy is 8% or more.

16. A casting process comprising a step of pouring a melt of a brass alloy according to claim 1 into a green sand mold, a furan mold, or a metal mold to form a casting.

17. The casting process according to claim 16, wherein the pouring step is conducted at a temperature from 930 to 1200° C.

18. The casting process according to claim 16, wherein the casting is subjected to a machining step to produce a machined workpiece and turning scraps thereof.

19. The casting process according to claim 18, wherein the melt of the brass alloy further comprises a re-melt from the machined workpiece or turning scraps thereof produced by the machining step of claim 18.

* * * * *